US009215930B2

(12) United States Patent
Weinkove et al.

(10) Patent No.: US 9,215,930 B2
(45) Date of Patent: Dec. 22, 2015

(54) STORAGE DEVICE

(71) Applicant: URSTCO, L.P., Austin, TX (US)

(72) Inventors: Martin Weinkove, Austin, TX (US); Osborne Kirby Walls, III, Austin, TX (US)

( * ) Notice: Subject to any disclaimer, the term of this patent is extended or adjusted under 35 U.S.C. 154(b) by 0 days.

(21) Appl. No.: 14/284,439

(22) Filed: May 22, 2014

(65) Prior Publication Data

US 2015/0238011 A1 Aug. 27, 2015

Related U.S. Application Data

(60) Provisional application No. 61/944,446, filed on Feb. 25, 2014.

(51) Int. Cl.
*A47B 91/00* (2006.01)

(52) U.S. Cl.
CPC ..... *A47B 91/00* (2013.01)

(58) Field of Classification Search
CPC ..... A47B 91/00
USPC ..... 312/296, 351.3, 351.5–351.9; 248/188.1; 108/186–188; 403/231
See application file for complete search history.

(56) References Cited

U.S. PATENT DOCUMENTS

| | | | | | |
|---|---|---|---|---|---|
| 2,380,379 | A * | 7/1945 | Attwood | A47B 13/003 | 211/189 |
| 3,237,779 | A * | 3/1966 | Eger | A47B 57/30 | 211/191 |
| 3,747,885 | A * | 7/1973 | Ciancimino | 248/188.1 | |
| 3,875,712 | A * | 4/1975 | Thompson | E04B 1/2403 | 108/153.1 |
| 3,885,765 | A * | 5/1975 | Richards | A47B 13/06 | 211/182 |
| 4,163,537 | A * | 8/1979 | Mourgue | 248/188.1 | |
| 4,665,838 | A * | 5/1987 | Minshall | A47B 47/021 | 108/157.13 |
| 5,310,066 | A * | 5/1994 | Konstant | 211/193 | |
| 6,296,336 | B1 * | 10/2001 | Hattori | 312/296 | |
| 6,481,177 | B1 * | 11/2002 | Wood | F16B 7/187 | 403/189 |
| D476,512 | S * | 7/2003 | Glass | D6/709 | |
| 2004/0036389 | A1 * | 2/2004 | Tsai | H05K 7/18 | 312/265.4 |
| 2009/0102337 | A1 * | 4/2009 | Grela | 312/294 | |

* cited by examiner

*Primary Examiner* — Matthew Ing
(74) *Attorney, Agent, or Firm* — Stephen Lewellyn; Maxey Law Office, PLLC

(57) ABSTRACT

In general, in one aspect, a storage device is provided. The storage device provides lockable elevated storage. The storage device includes a housing assembly and a base assembly. The housing assembly includes a housing body, a strut, a door assembly, a door seal, and a hinge. The base assembly includes at least two left leg assemblies, at least two right leg assemblies, at least one horizontal transverse member, at least two horizontal longitudinal members, at least two first stabilizing brackets, and at least two second stabilizing brackets.

15 Claims, 23 Drawing Sheets

STORAGE DEVICE

CROSS-REFERENCE TO RELATED APPLICATIONS

This application claims the benefit of U.S. Provisional Application No. 61/944,446, filed Feb. 25, 2014, the entirety of which is incorporated herein by reference.

FIELD OF THE INVENTION

The present invention relates to storage devices, more particularly, the present invention relates to a free-standing, elevated storage device for placement within vehicle parking space while allowing vehicle access to the parking space for parking.

BACKGROUND OF THE INVENTION

Storage devices that allow for other items to be positioned below the storage device are desirable for both private and public locations. Such storage devices are generally wall or ceiling mounted and require support from the wall or ceiling to which they are mounted. These wall or ceiling mounted storage devices require modification of the permanent structures for attachment. This required modification to the vehicle parking space may not be feasible or may be undesirable to the user.

While the devices heretofore fulfill their respective, particular objectives and requirements, they do not provide a standalone storage device for use in connection with a vehicle parking space which does not require attachment to a permanent structure, as such there exists and need for a storage device, which substantially departs from the prior art, and in doing so provides an apparatus primarily developed for the purpose of providing a standalone storage device for use in connection with a vehicle parking space.

SUMMARY OF THE INVENTION

In view of the foregoing disadvantages inherent in the known types of storage devices including support methods now present in the prior art, the present invention provides a new storage device wherein the same can be used for providing a storage device without attachment to a permanent structure for positioning.

In accordance with the present invention, a storage device for use with a vehicle storage space is provided that does not require attachment to a permanent structure.

In general, in one aspect, a storage device is provided. The storage device includes a housing assembly having a rectangular housing body that has a bottom wall, and a rectangular base assembly. The rectangular base assembly includes a leg positioned at each corner of the rectangular base and each leg including a vertical channel. Four stabilizing brackets, one attached to each of the four legs within the vertical channel and extending outwardly therefrom. A first horizontal member is attached at one end to a first stabilizing bracket of a first leg and is attached at its opposite end to a second stabilizing bracket of a second leg. And, longitudinally extends between the first and the second legs along a back side of the rectangular base assembly. A second horizontal member is attached at one end to a third stabilizing bracket of a third leg and is attached at its opposite end to a fourth stabilizing bracket of a fourth leg. And, longitudinally extends between the third and fourth legs along a front side of the rectangular base assembly. Wherein the housing assembly is disposed on and supported by the rectangular base assembly. And, wherein the bottom wall of the housing body is directed connected to each of the first and second horizontal members by a plurality of bolted connections that are spaced along each of the first and second horizontal members.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
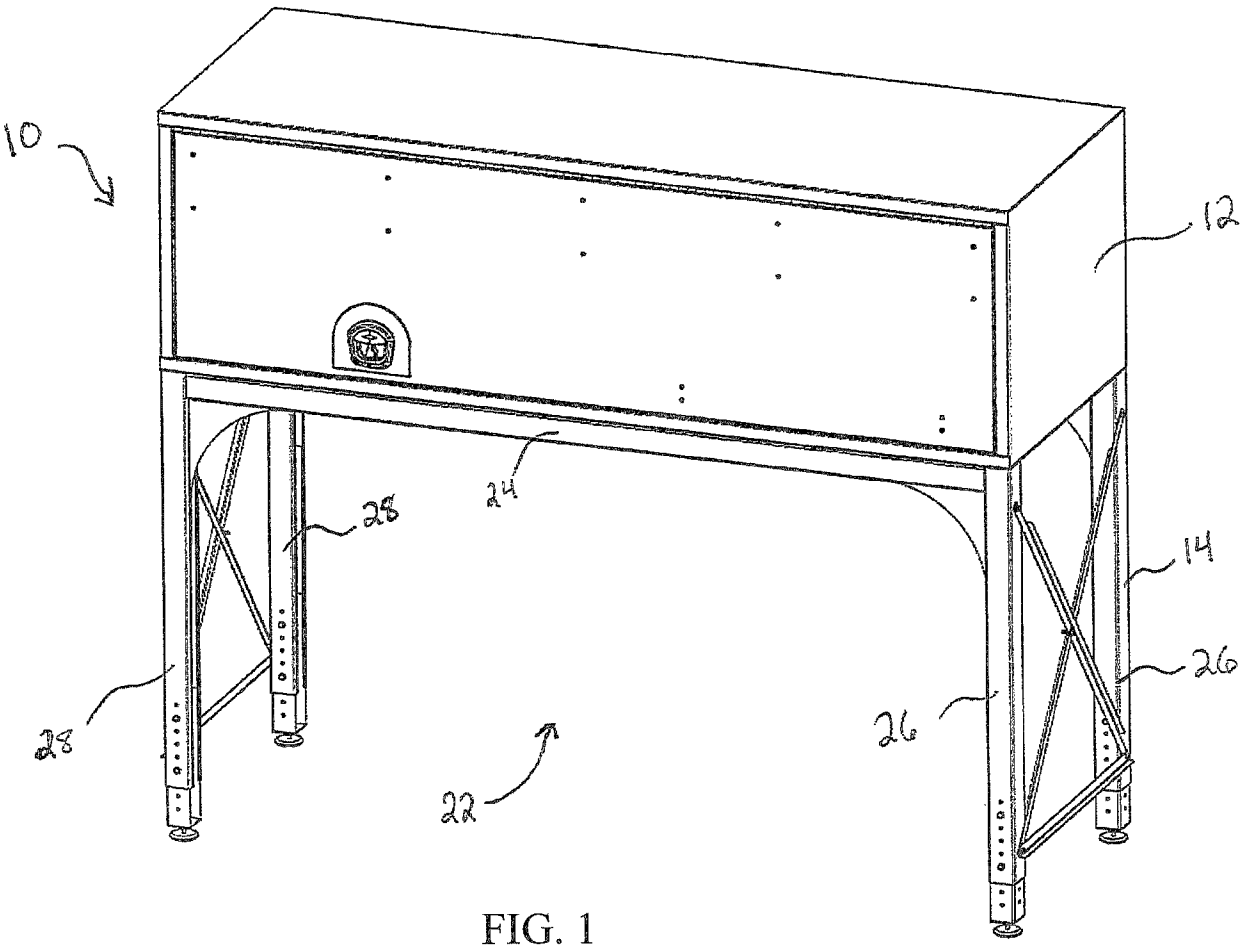
FIG. 1 is a perspective view of the storage device in accordance with the principles of an embodiment of the present invention.
Figure 2:
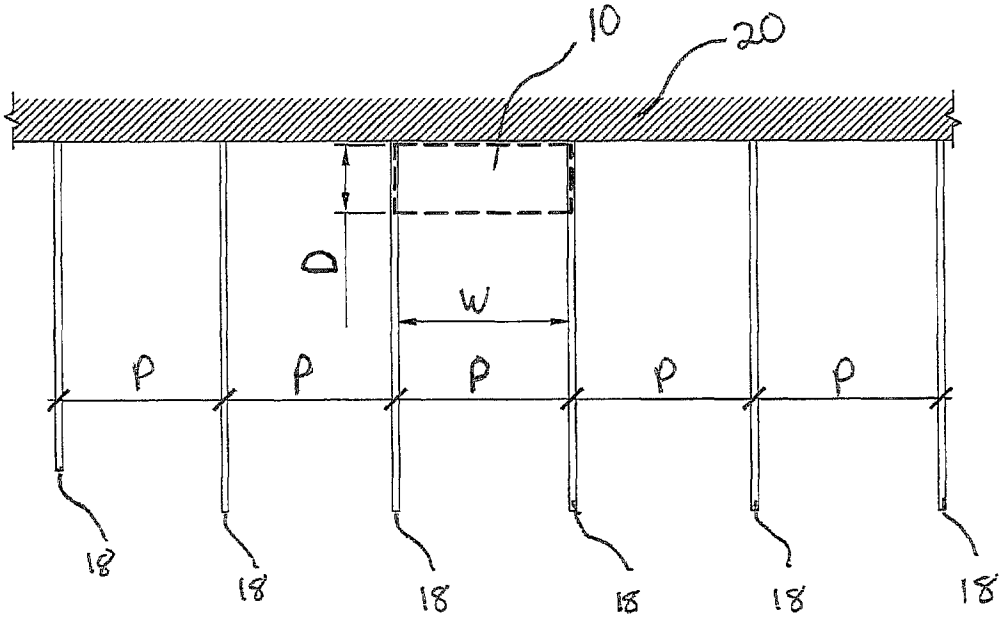
FIG. 2 is a schematic view of storage device positioned in a parking space.
Figure 4:
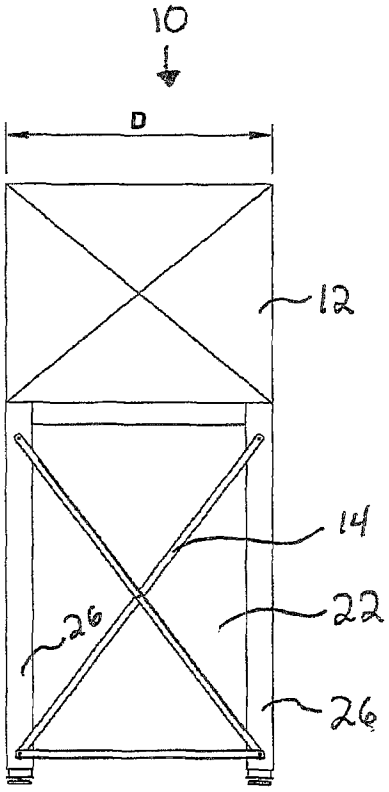
FIG. 4 is a left side view of a storage device.
Figure 3:
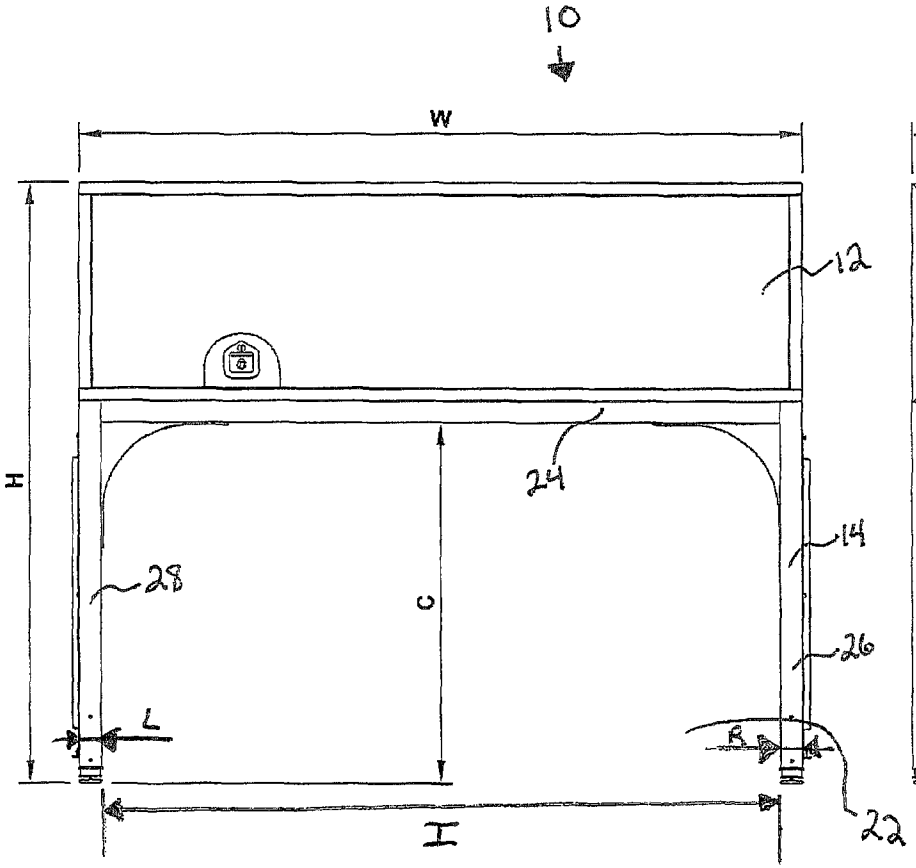
FIG. 3 is front view of a storage device.
Figure 5:
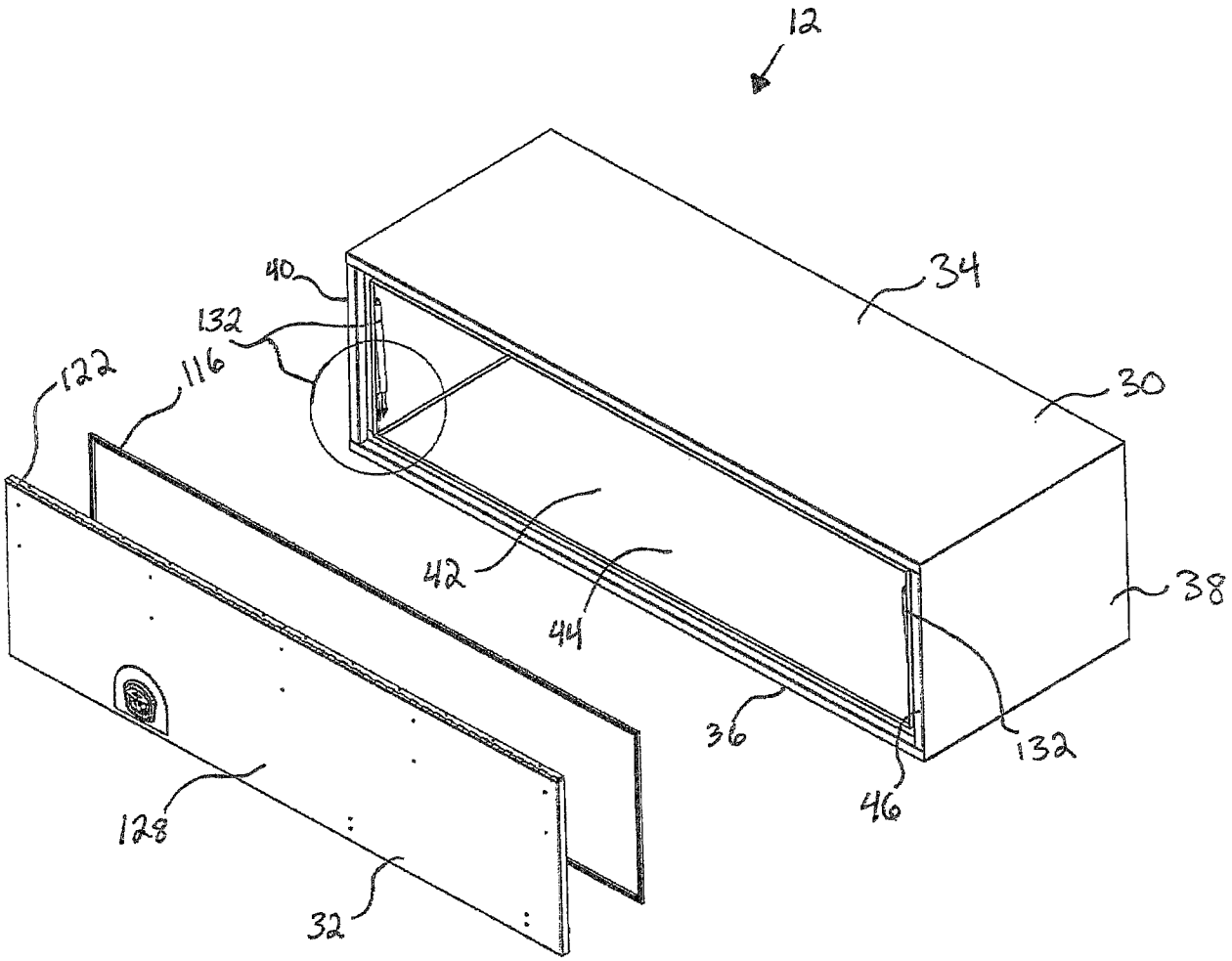
FIG. 5 is an exploded view of a housing assembly of a storage device.
Figure 6:
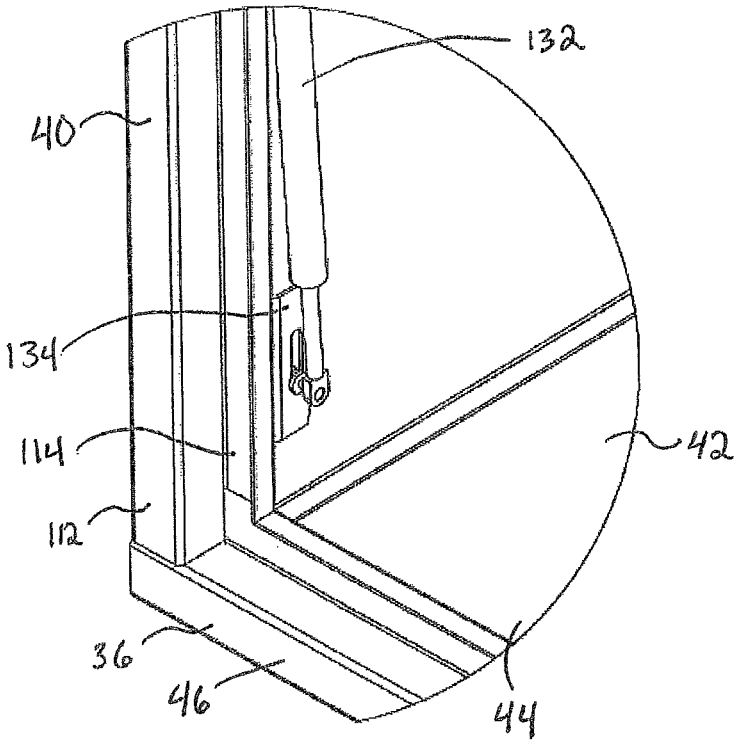
FIG. 6 is a detailed view of a housing assembly of a storage device.
Figure 7:
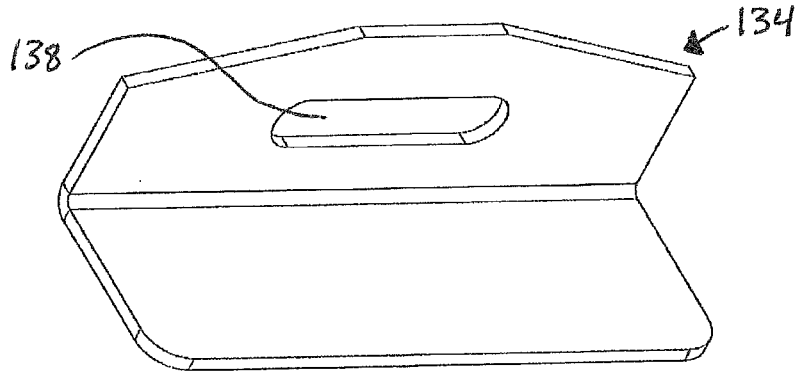
FIG. 7 is a perspective view of a lower strut mount of a storage device.
Figure 8:
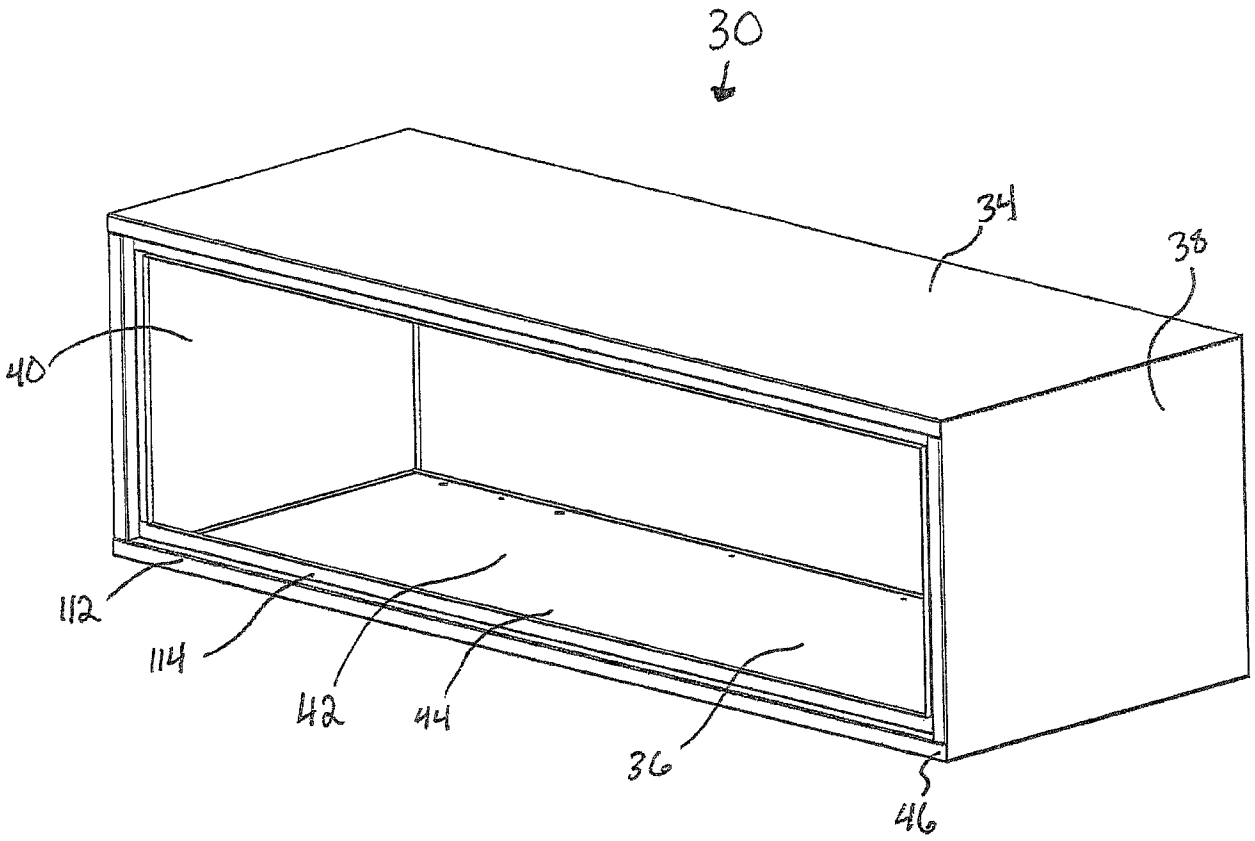
FIG. 8 is a perspective view of a housing body of a storage device.
Figure 9:
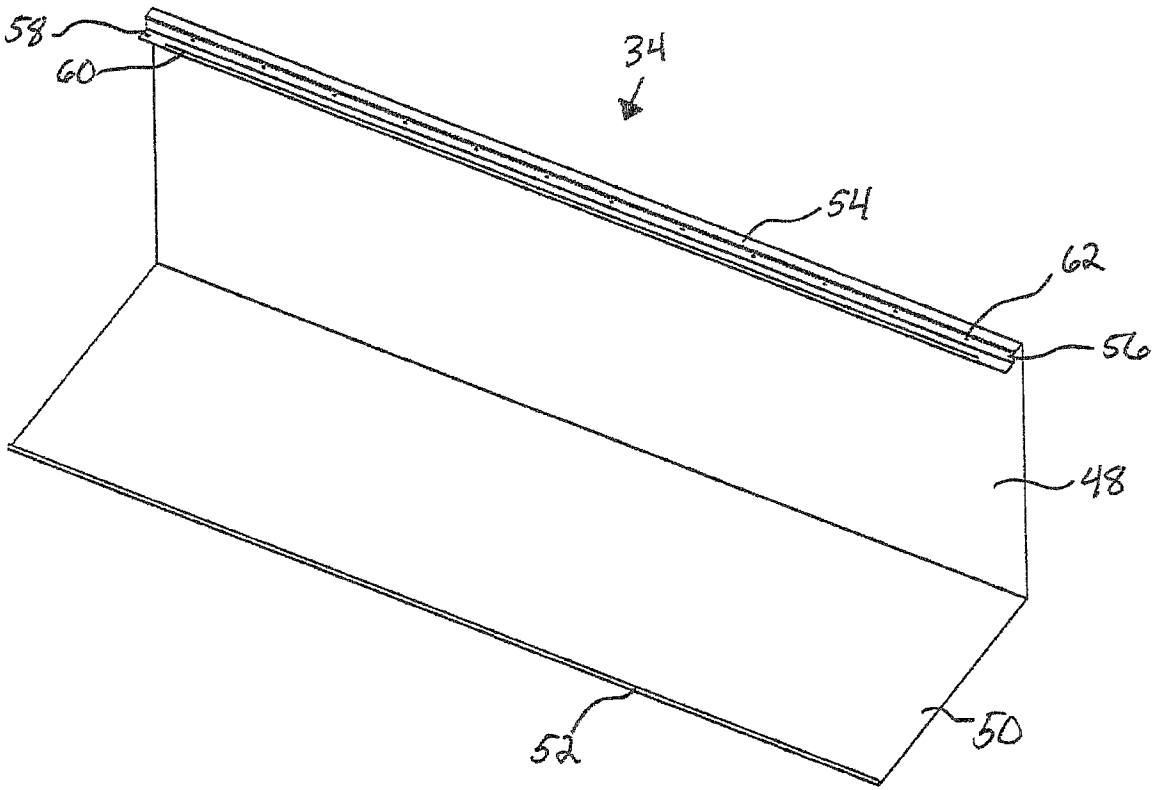
FIG. 9 is a perspective view of a top body panel of a storage device.
Figure 10:
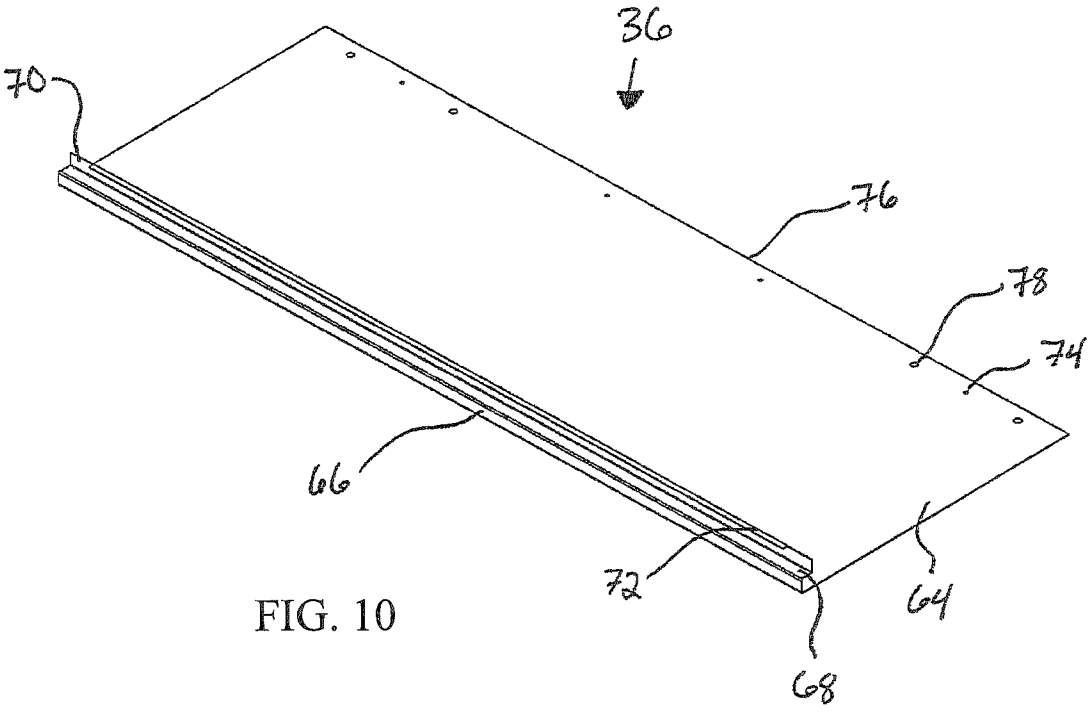
FIG. 10 is a perspective view of a bottom body panel of a storage device.
Figure 11:
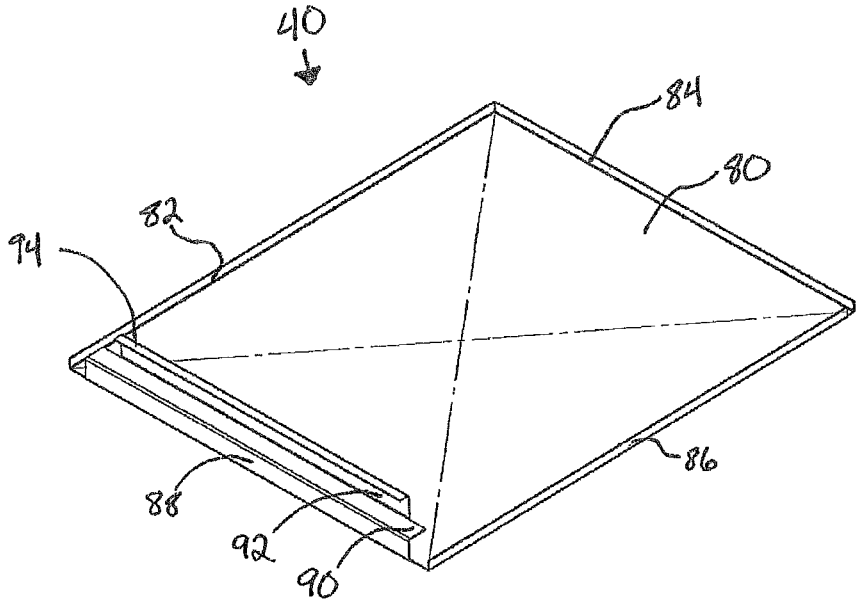
FIG. 11 is a perspective view of a left body panel of a storage device.
Figure 12:
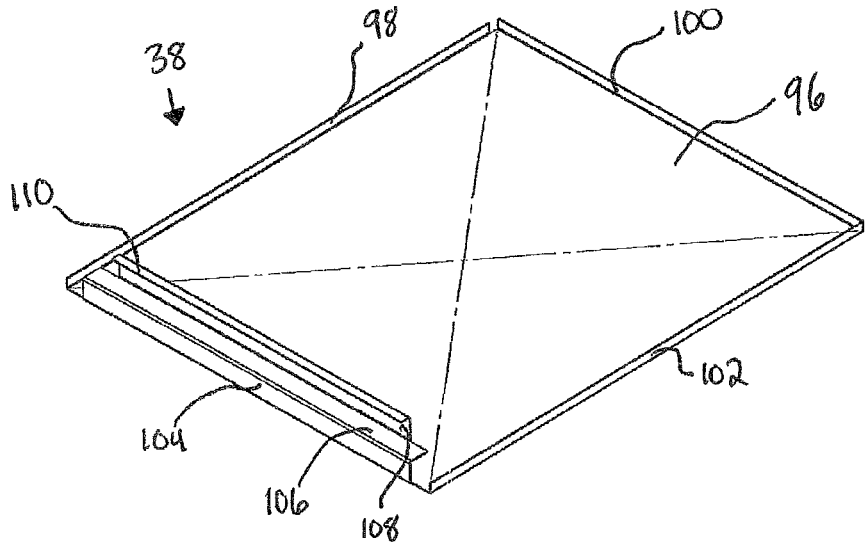
FIG. 12 is a perspective view of a right body panel of a storage device.
Figure 13:
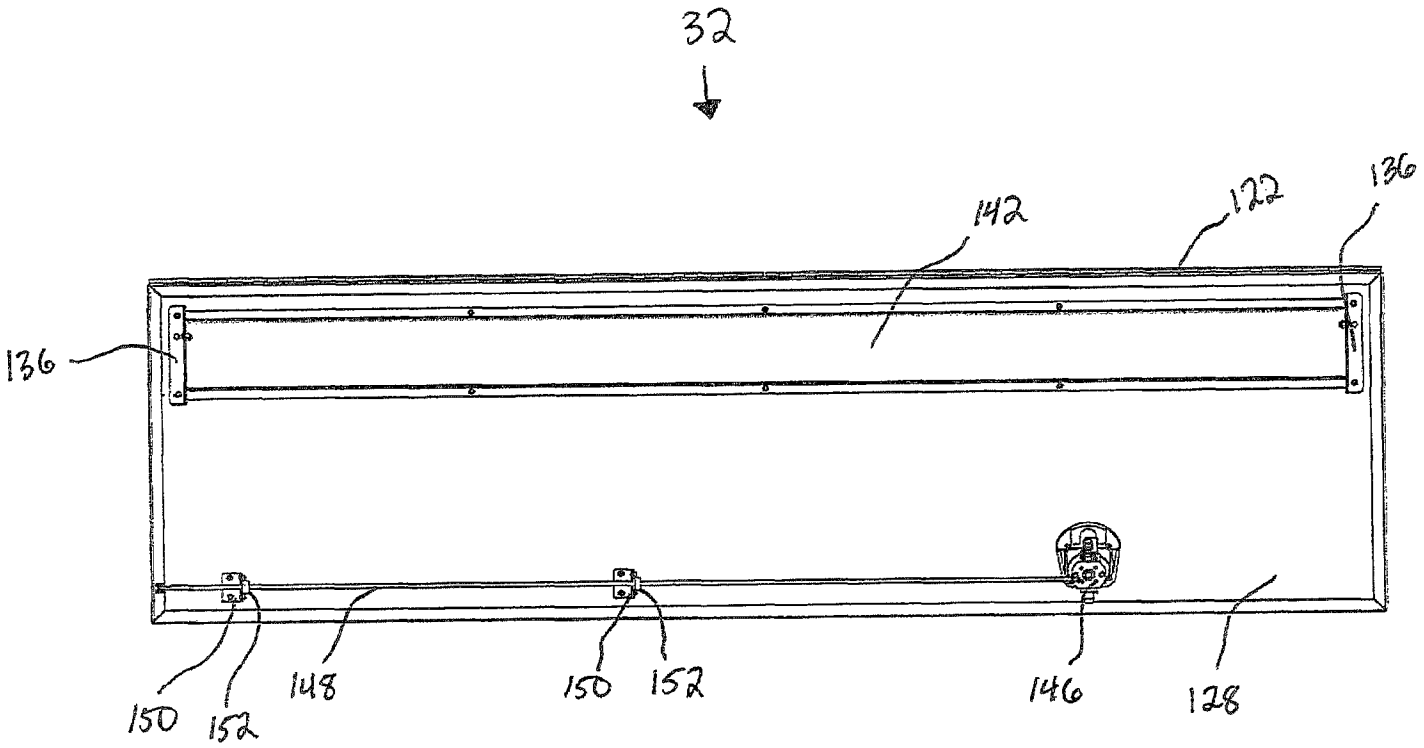
FIG. 13 is a rear elevation view of a door assembly of a storage device.
Figure 14:
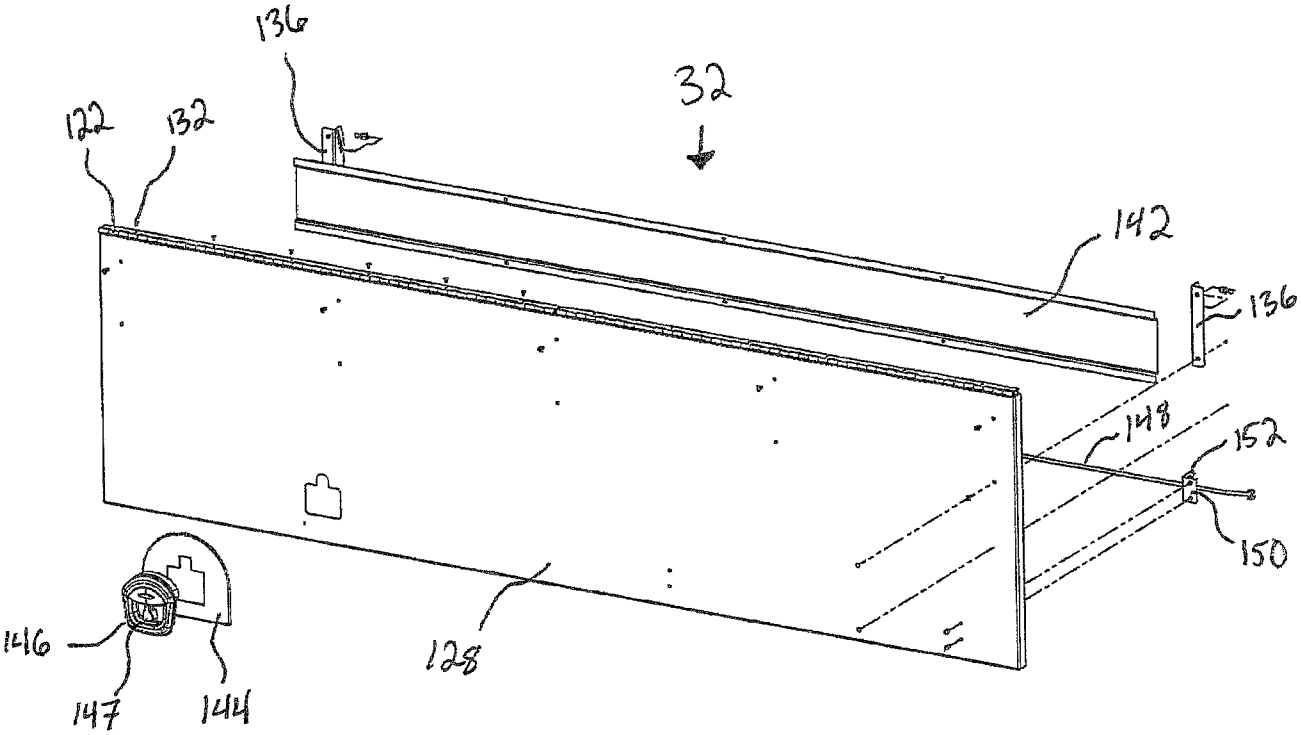
FIG. 14 is an exploded view of a door assembly of a storage device.
Figure 15:
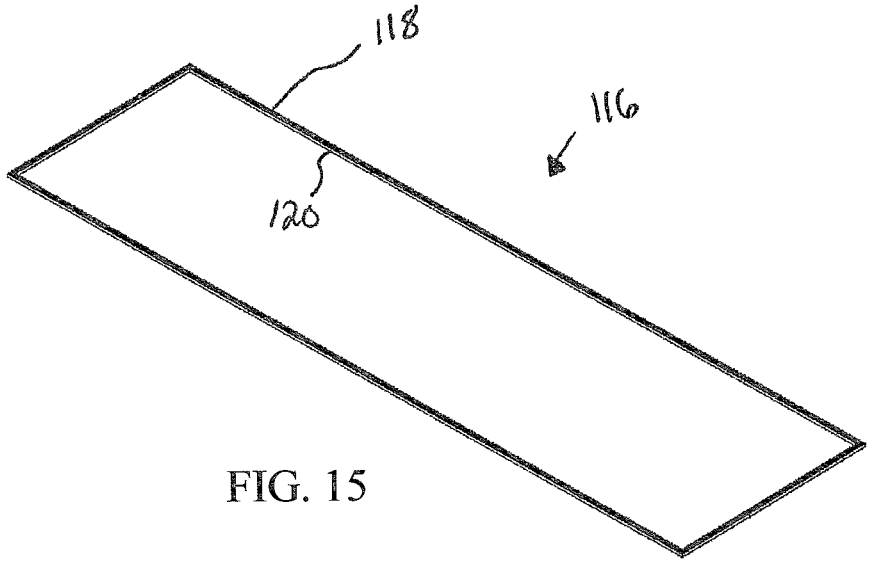
FIG. 15 is a perspective view of a door seal of a storage device.
Figure 16:
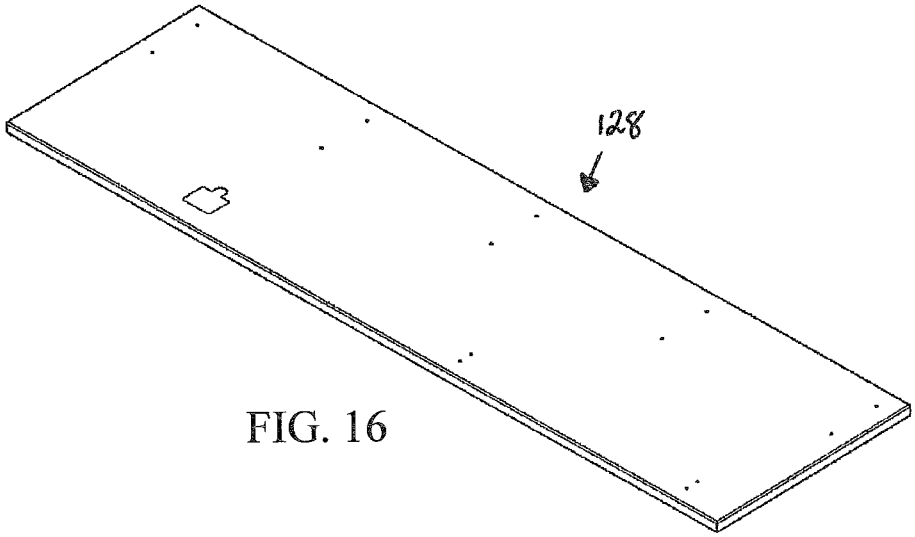
FIG. 16 is a perspective view of a door plate of a storage device.
Figure 17:
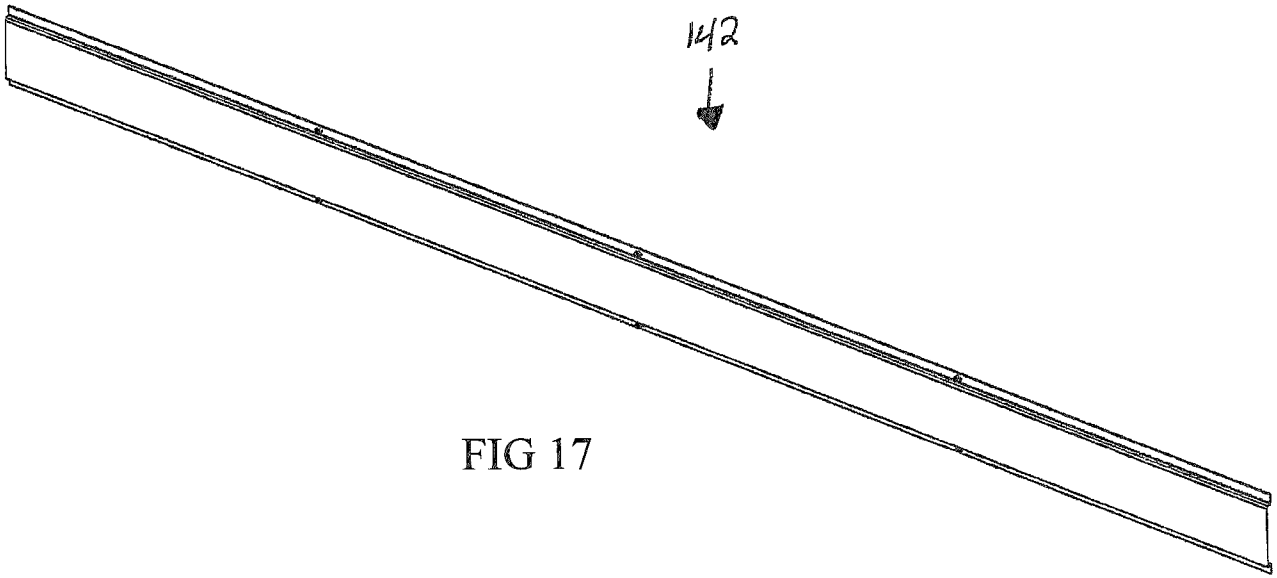
FIG. 17 is a perspective view of a door stiffening beam of a storage device.
Figure 20:
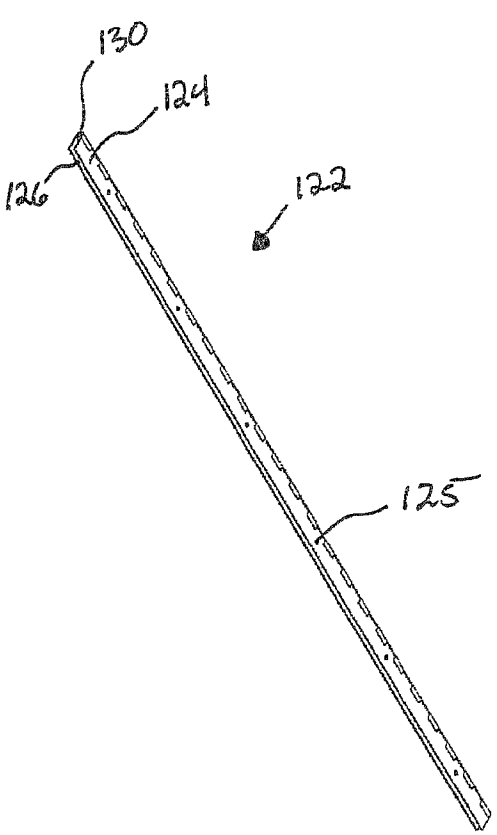
FIG. 20 is a perspective view of a hinge of a storage device.
Figure 19:
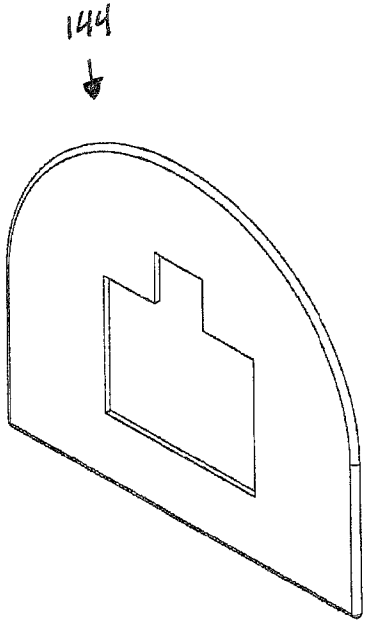
FIG. 19 is a perspective view of a lock backing bracket of a storage device.
Figure 18:
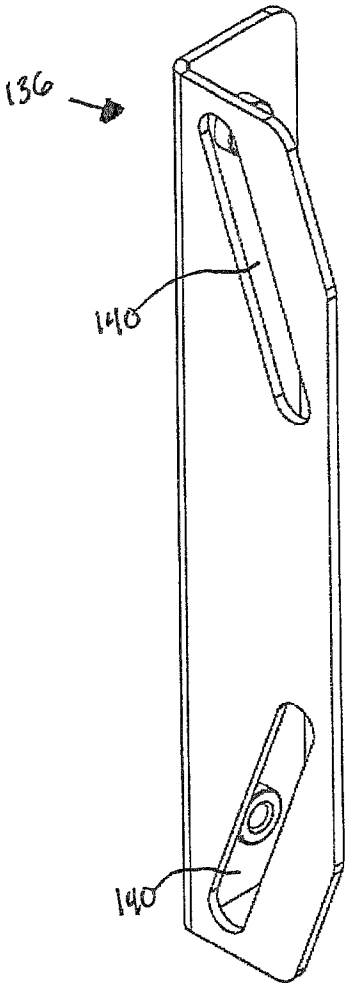
FIG. 18 is a perspective view of an upper strut mount of a storage device.
Figure 21:
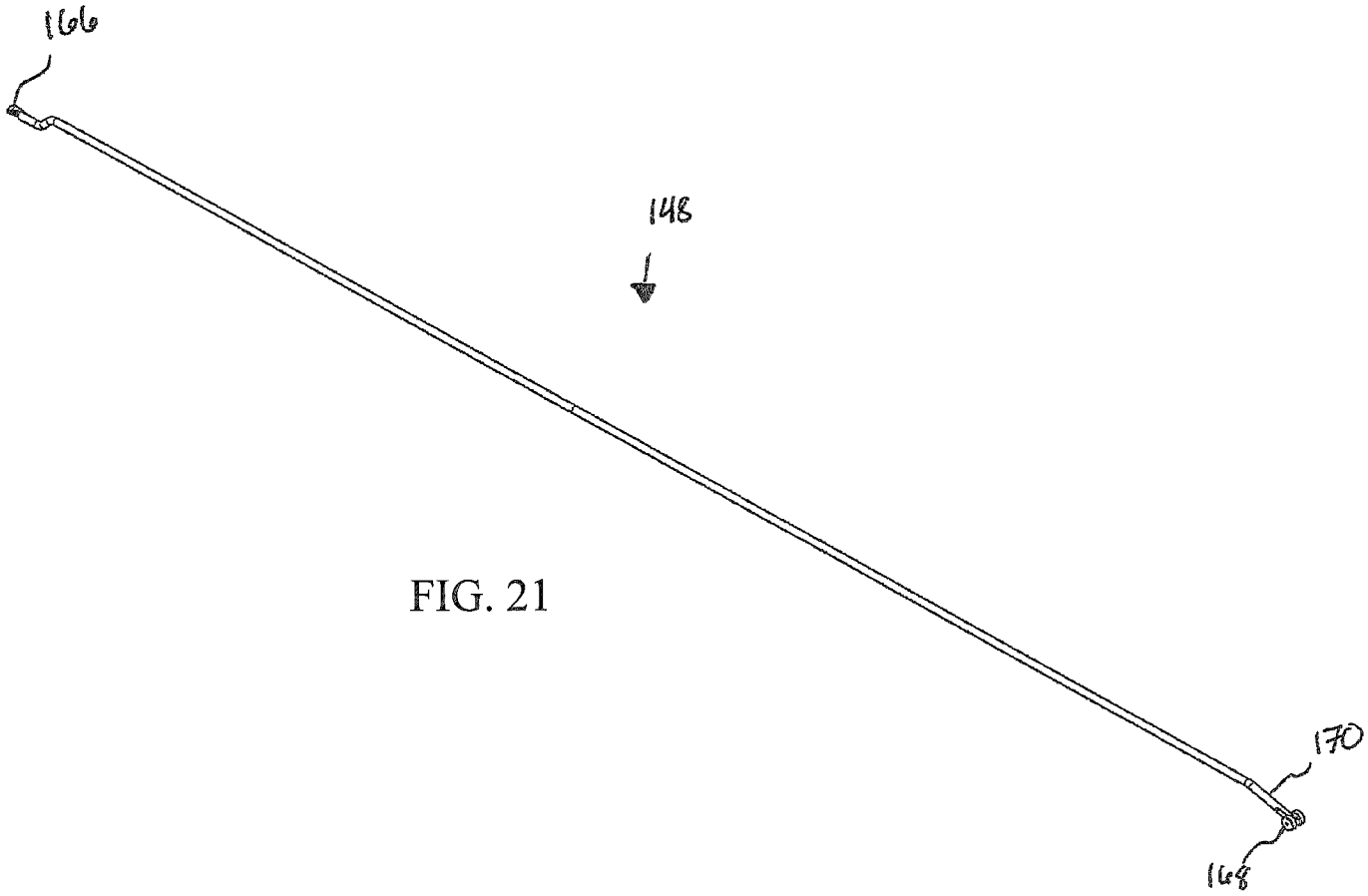
FIG. 21 is a perspective view of a locking rod of a storage device.
Figure 23:
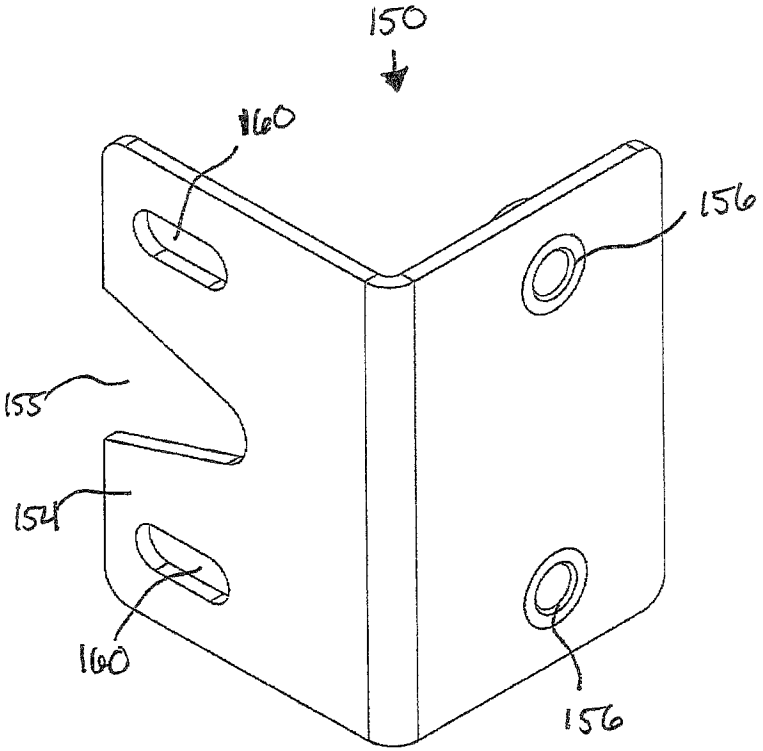
FIG. 23 is a perspective view of a rod mounting base of a storage device.
Figure 22:
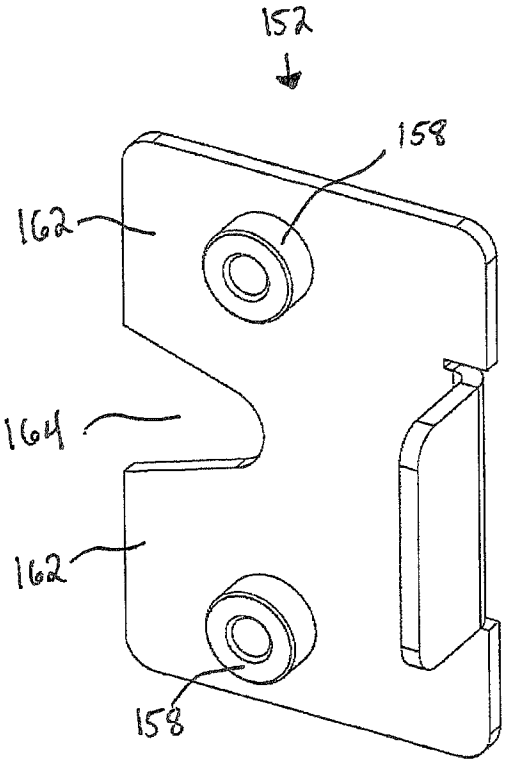
FIG. 22 is a perspective view of a rod mounting cover of a storage device.
Figure 24:
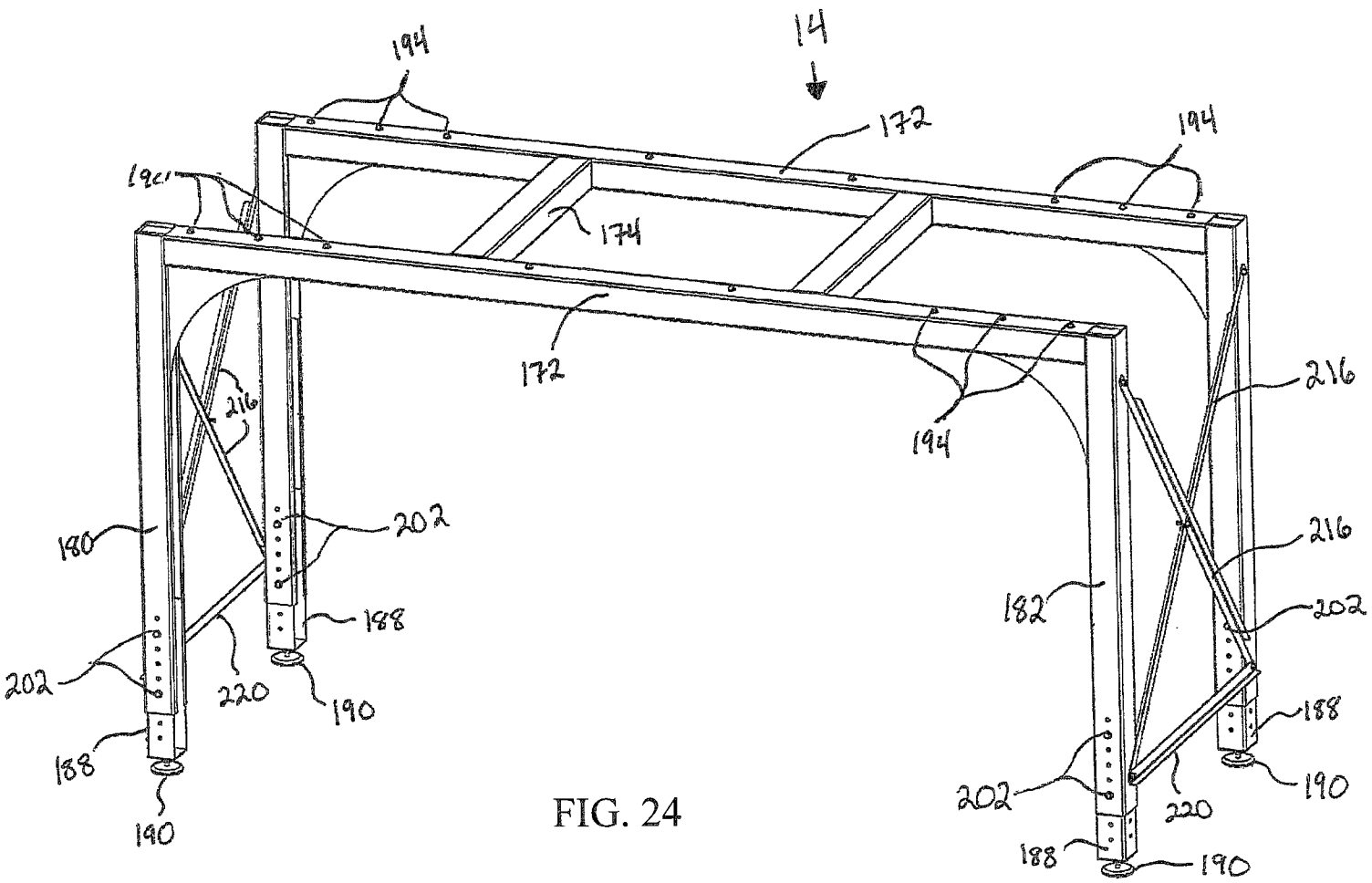
FIG. 24 is a perspective view of a base assembly of a storage device.
Figure 26:
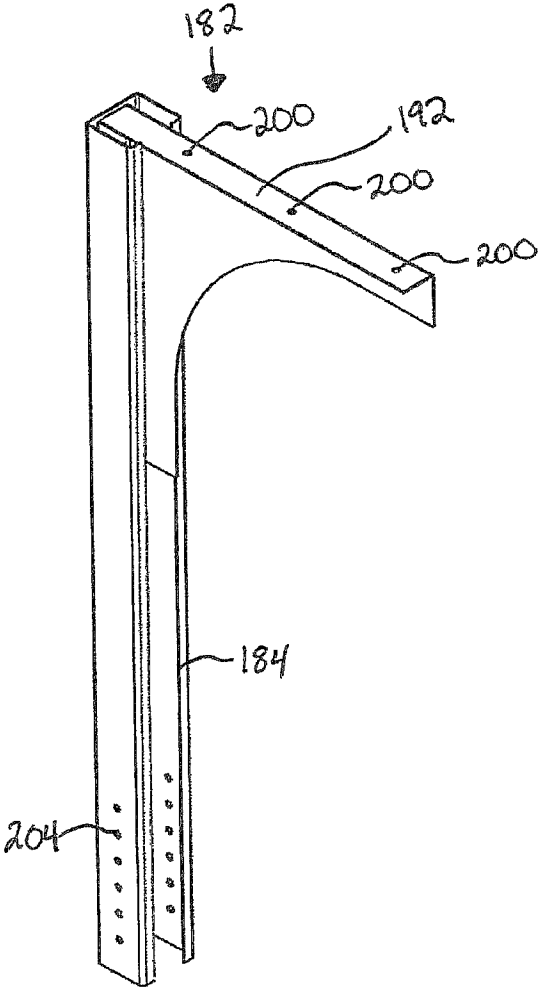
FIG. 26 is a perspective view of a right leg assembly of a storage device.
Figure 25:
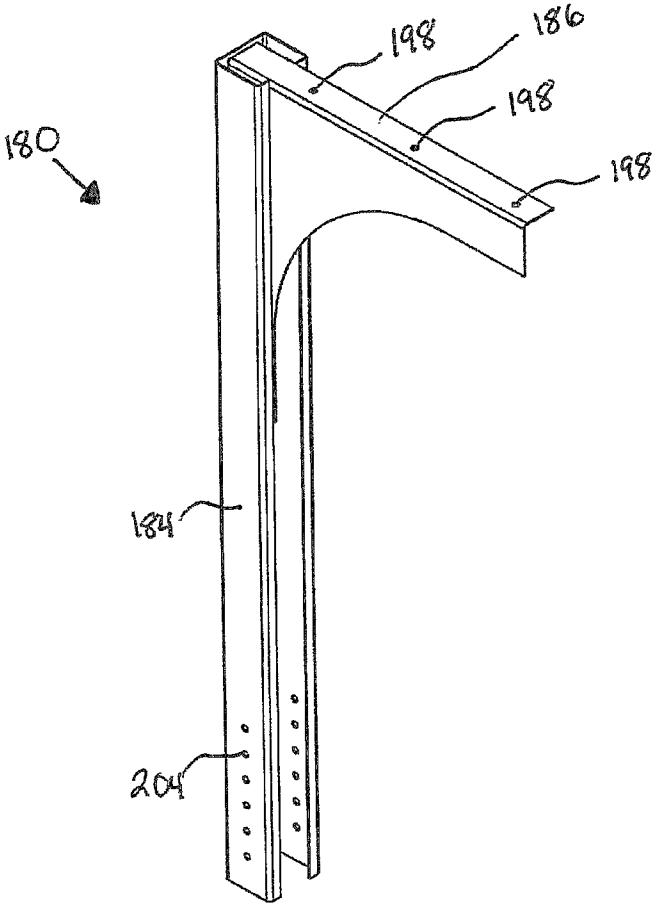
FIG. 25 is a perspective view of a left leg assembly of a storage device.
Figure 29:
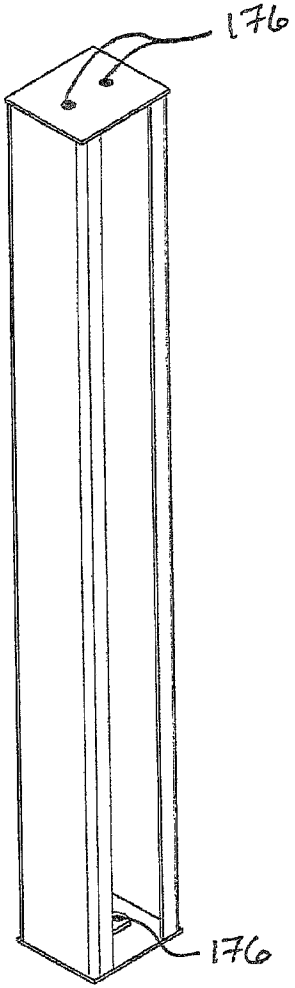
FIG. 29 is a perspective view of a horizontal transverse member of a storage device.
Figure 28:
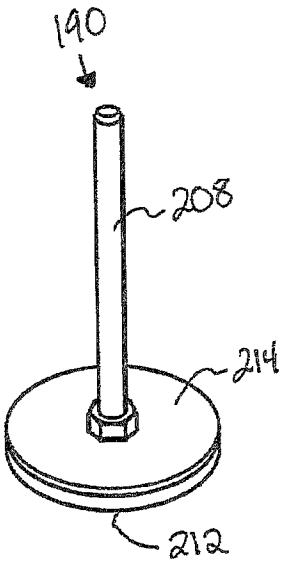
FIG. 28 is a leveling foot of a storage device.
Figure 27:
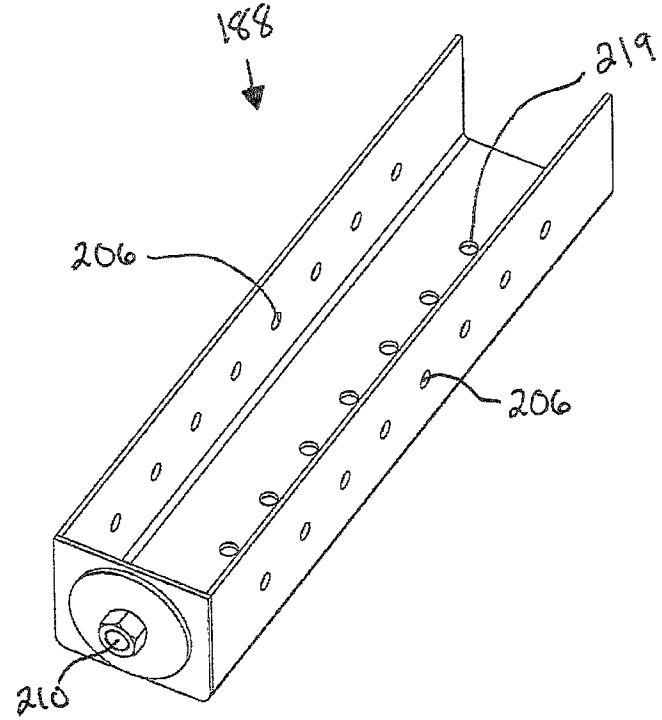
FIG. 27 is a perspective view of a leg extension of a storage device.
Figure 30:
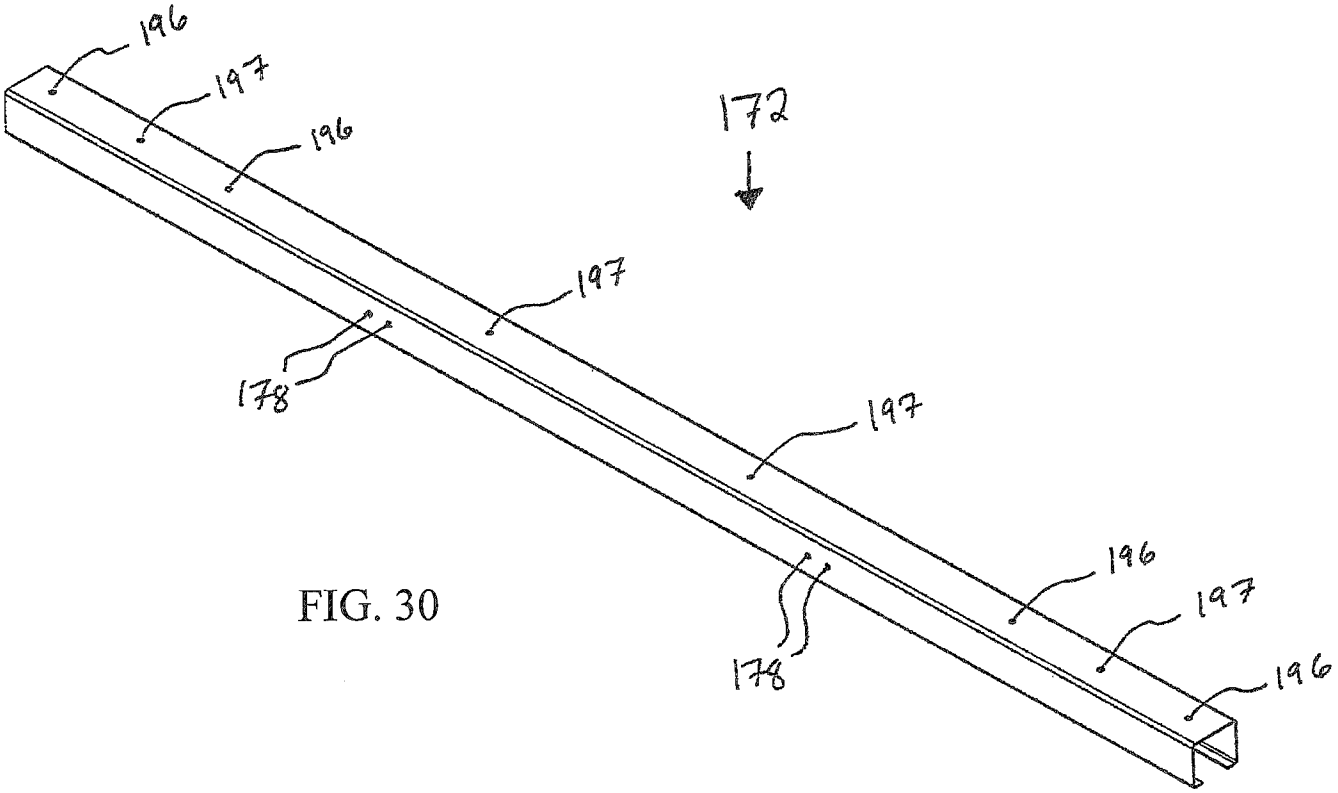
FIG. 30 is a perspective view of a horizontal longitudinal member of a storage device.
Figure 31:
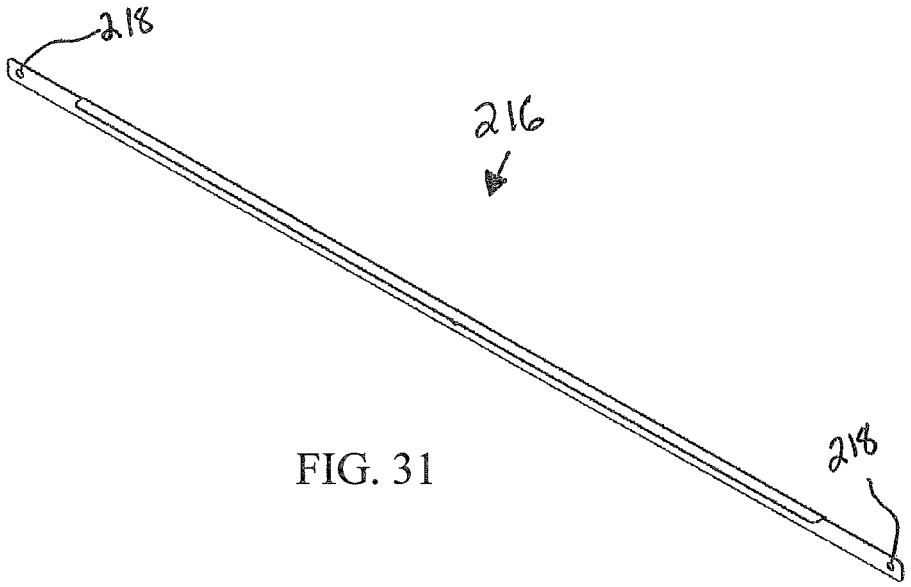
FIG. 31 is a perspective view of a first stabilizing bracket of a storage device.
Figure 32:
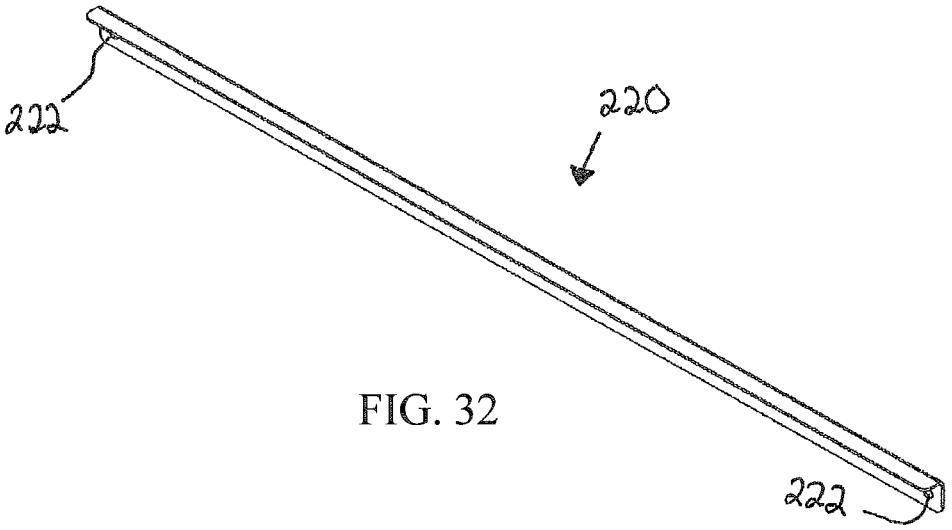
FIG. 32 is a perspective view of a second stabilizing bracket of a storage device.

In exemplary application, the storage device could be used in a parking garage with many parking spaces which are open to access by persons other than the resident of the space. The storage device provides an enclosed storage that fits within a single parking space. The storage device allows the front end (or rear end) of an automobile to be positioned under the enclosed portion of the storage device, thereby requiring no alteration to the normal parking position of the vehicle within the parking space.

Now with reference to FIGS. 1 through 4, there is representatively illustrated a storage device 10 constructed in accordance with an embodiment of the present invention. The storage device includes a housing assembly 12 and a base assembly 14. The storage device 10 is configured so that the outer width W of the storage device 10 fits within a conventional parking space 16. The parking space 16 has a parking space width P measured from the two surrounding perimeters 18, such as centerline of lines painted on the ground. Parking Space width P will preferably be between ninety-one inches and ninety-eight inches.

The storage device 10 is configured to be positioned along the end of the parking space 20 opposite the parking space entrance. The storage device 10 is designed so that the outer width W fits within the parking space width P. The storage device 10 is designed with an open space 22 bounded by the horizontal longitudinal support 24, the right leg 26 and the left leg 28.

The open space 22 has an interior height C and an interior width I. Interior width I is the resultant width of the outer width W minus the width R of the right leg 26 and the width L of the left leg 28. The interior height C is adjustable due to adjustability of the base assembly 14. The storage device 10 is configured so that the interior height C at a depth D measured from the rear side of the storage device 10 is greater than the height of a standard motor vehicle when the front end of the passenger vehicle is positioned within open space 22. Depth D must provide stability for the storage device 10 while also accommodating standard passenger vehicle heights at a position from the front end of the vehicle that corresponds with depth D when the front of the vehicle is positioned within open space 22. Depth D will preferably be a minimum of thirty-six inches to ensure sufficient stability of the storage device 10.

Now with reference to FIGS. 5 through 23, there is representatively illustrated the housing assembly 12 in accordance with an embodiment of the invention. The housing assembly 12 includes a housing body 30 and a door assembly 32. The housing body 30 includes a top body panel 34, a bottom body panel 36, a right body panel 38, and a left body panel 40. The top body panel 34, the bottom body panel 36, the right body panel 38, and the left body panel 40 collectively form a rectangular box shape including a storage space 42 with a rectangular opening 44 at the front face 46 of the housing body 30.

The top body panel 34 includes a top plate 48, a back plate 50, a bottom lip 52, a front plate 54, a top step 56, a recessed plate 58, and a lower step 60. The top step includes a plurality of top apertures 62. The top apertures 62 are arranged along the length of the top step 56 and are through the entire thickness of the top step 56.

The bottom body panel 36 includes a bottom plate 64, a forward plate 66, a bottom step 68, a rear plate 70, and a stop 72. The bottom plate 64 also includes a plurality of bottom mounting apertures 74. The bottom mounting apertures 74 are arranged along the length of the bottom plate 64 near the forward plate 66 and a rear edge 76. The bottom mounting apertures 74 are through the entire thickness of the bottom plate 64. The bottom plate 64 further includes a plurality of bottom clearance apertures 78. The bottom clearance apertures 78 are arranged along the length of the bottom plate 64 near the forward plate 66 and a rear edge 76. The bottom clearance apertures 74 are through the entire thickness of the bottom plate 64.

The left body panel 40 includes a left plate 80, a left top plate 82, a left back plate 84, a left bottom plate 86, a left front plate 88, a left step 90, a left inner plate 92, and a left ledge 94. The right body panel 38 includes a right plate 96, a right top plate 98, a right back plate 100, a right bottom plate 102, a right front plate 104, a right step 106, a right inner plate 108, and a right ledge 110.

The front plate 54, the forward plate 66, left front plate 88, and the right front plate 104 collectively form a front body surface 112. The recessed plate 58, a rear plate 70, the left inner plate 92, and the right inner plate 108 collectively form a front recessed surface 114. The housing assembly 12 includes a door seal 116 that is configured to fit against the front recessed surface 114. The outer surfaces 118 of the door seal 116 fit within the top step 56, the bottom step 68, the left step 90, and the right step 106. The inner surfaces 120 of the door seal 116 fit outside the lower step 60, the stop 72, left ledge 94, and the right ledge 110.

The door assembly 32 is rotatably connected to the housing body 30 with a hinge 122. A first hinge portion 124 is connected to the top body panel 34 of the housing body 30. The first hinge portion 124 having a length, a width, and a thickness, includes a plurality of first hinge apertures 125 along its length. The plurality of first hinge apertures 125 are through the entire thickness of the first hinge portion 124. A plurality of fasteners affix the first hinge portion 124 to the housing body 30 through the plurality of first hinge apertures 125 and the plurality of top apertures 62.

A second hinge portion 126 is connected to a door plate 128 of the door assembly 32. The second hinge portion 126, having a length, a width, and a thickness, includes a plurality of second hinge apertures along its length. The plurality of second hinge apertures are through the entire thickness of the second hinge portion 126. A plurality of fasteners 132 affix the second hinge portion 126 to the door assembly 32 through the plurality of second hinge apertures 125 and a plurality of top door apertures. A hinge pin 130 connects the first hinge portion 124 and the second hinge portion 126.

Rotation of the door assembly 32 about the hinge 122 is regulated by at least one strut 132 connected between the housing body 30 and the door assembly 32. The strut 132 is affixed to a lower strut mounting bracket 134 which is affixed the housing body 30. The strut 132 is affixed to an upper strut mounting bracket 136 which is affixed to the door assembly 32. The lower strut mounting bracket 134 allows for adjustment of the positioning of the strut 132 through an elongated lower strut aperture 138. The upper strut mounting bracket 136 allows for adjustment of the positioning of the strut 132 through an elongated upper strut aperture 140.

The door seal 116 is positioned between the housing body 30 and the door assembly 32. The door seal 116 has sufficient thickness so that when the door is in a closed position, the door seal 116 contacts both the front recessed surface 114 and the door plate 128. The door seal 116 is made of a resilient material, preferably an elastomeric material.

The door assembly 32 includes the door plate 128, the upper strut mounting bracket 136, a door stiffening beam 142, a lock backing bracket 144, a lock assembly 146, a lock rod 148, at least one rod mounting base 150, and at least one rod mounting cover 152. The lock assembly 146 is of a type well known in the art. The lock assembly 146 includes both a keyed internal lock and an exterior aperture to allow for a padlock. The lock assembly 146 includes a handle 147 which is substantially parallel with the door plate 128 when in the locked position. The handle 147 is rotated toward perpendicular with the door plate 128 until it reaches a free position. When in the free position, the handle 147 may be rotated about a center axis of the lock assembly 146 which in turn moves the lock rod 148 which is affixed to the back of the lock assembly 146.

The lock rod 148 is positioned by the rod mounting base 150 which partially surrounds the lock rod 148 with mount flanges 154. The flanges form a rod mount passage 155. The rod mounting base 150 includes weld nuts 156 which are adapted to cooperate with apertures on the door plate 128 to allow for fasteners to affix the rod mounting base to the door plate 128.

The rod mounting cover 152 is affixed to the rod mounting base 150. The rod mounting cover 152 includes weld nuts 158 which are adapted to cooperate with rod mount apertures 160 of the rod mounting base so that fasteners may affix the rod mounting cover 152 to the rod mounting base 150. The rod mounting cover partially surrounds the lock rod 148 by cover flanges 162 that form a cover passage 164. The mounting passage 155 and the cover passage 164 together form an aperture through which the lock rod 148 may travel in a linear direction along its axis when driven by the lock assembly 146.

The lock rod 148 includes a lock aperture 166 which is adapted to receive an external drive member of the lock assembly 146. The lock rod 148 may optionally include a rolling element 168. The rolling element 168 reduces friction to during linear movement of the lock rod 148.

In operation, the lock assembly 146 drives the lock rod 148 linearly between an unlocked position and a locked position. In the unlocked position locking end 170, including the rolling element 168, of the lock rod 148 is positioned fully within the outer dimensions of the door plate 128. In the locked position, the locking end 170 of the lock rod 148 extends beyond the outer dimensions of the door plate 128 and protrudes behind the front recessed surface 114. When the locking end 170 of the lock rod 148 is positioned behind the recessed surface 114 it prevents rotation of the door assembly 32 from a closed position to an open position. When the door assembly 32 is in the closed position, the door assembly 32 is substantially aligned with front body surface 112.

Now with reference to FIGS. 24 through 32, there is representatively illustrated the base assembly 14 in accordance with an embodiment of the invention. The base assembly includes at least two laterally spaced, longitudinally extending horizontal members 172. At least one transverse member 174 is attached to and extends horizontally between horizontal longitudinal members 172. The horizontal transverse member 174 includes transverse apertures 176 located on the ends of the horizontal transverse member 174. The horizontal longitudinal members include first longitudinal apertures 178 located on the side of the horizontal longitudinal members 172. The horizontal transverse member 174 is affixed to the horizontal longitudinal members 172 by fasteners which are positioned through transverse apertures 176 and first longitudinal apertures 178.

The base assembly 14 further includes at least two left leg assemblies 180 and two right leg assemblies 182. The left leg assembly 180 includes a leg beam 184, a single C-shaped vertical channel 185, a left member support 186, a leg extension 188, and a leveling foot 190. The right leg assembly 182 includes the leg beam 184, a single C-shaped vertical channel 185, a right member support 192, the leg extension 188, and the leveling foot 190.

The left leg assembly 180 is affixed to the horizontal longitudinal member 172 by a plurality of fasteners 194 positioned through a plurality of outer member apertures 196 on the horizontal longitudinal member and a plurality of left mount apertures 198 on the left member support 186. The right leg assembly 182 is affixed to the horizontal longitudinal member 172 by a plurality of fasteners 194 positioned through a plurality of outer member apertures 196 on the horizontal longitudinal member and a plurality of right mount apertures 200 on the right member support 186. The leg extension 188 is affixed to the leg beam 184 by extension fasteners 202 positioned through a plurality of leg beam apertures 204 and a plurality of extension apertures 206.

The leveling foot 190 is affixed to the leg extension 188 through a threaded rod portion 208 of the leveling foot 190 inserted into a threaded aperture 210 located on the bottom of the leg extension 188. The leveling foot 190 also includes an elastomeric base surface 212 to provide greater adhesion between the leveling foot and the ground. The leveling foot 190 also includes a metal backing plate 214 to provide a strong support for the elastomeric base surface 212.

The base assembly 14 also includes at least one first stabilizing bracket 216 per side. Each first stabilizing bracket 216 ties together either the two left leg assemblies 180 or the two right leg assemblies 182. The first stabilizing bracket 216 is assembled in a diagonal position from the upper portion of one leg beam 184 to the lower portion of the other leg beam 184. The first stabilizing bracket 216 is affixed to the left leg assemblies 180 or the right leg assemblies 182 by fasteners positioned through the first apertures 218 of the first stabilizing bracket 216, the stabilizing apertures of the leg beams 184, and the stabilizing apertures 219 of the leg extensions 188.

The base assembly 14 further includes one second stabilizing bracket 220 per side. Each second stabilizing bracket 220 ties together either the two left leg assemblies 180 or the two right leg assemblies 182. The second stabilizing bracket 220 is assembled in a horizontal position between the lower portions of the other leg beams 184. The second stabilizing bracket 220 is affixed to the left leg assemblies 180 or the right leg assemblies 182 by fasteners positioned through the second apertures 222 of the second stabilizing bracket 220, the stabilizing apertures of the leg beams 184, and the stabilizing apertures 219 of the leg extensions 188.

In operation, the leg extensions 188 may each be positioned further into or out of the leg beams 184 to adjust the height of the storage device 10. The leg extensions 188 may also be positioned further into or out of the leg beams 184 to adjust for unevenness of the ground upon which the storage device 10 is to be positioned. Each leveling foot 190 may also be adjusted to make more fine adjustments for unevenness of the ground upon which the storage device 10 is to be positioned and to ensure that the storage device 10 is level.

The housing assembly 12 is affixed to the base assembly 14 by a plurality of fasteners that are positioned through the bottom mounting apertures 74 of the bottom plate 64 and a plurality of connecting apertures 197 on the top surface of the horizontal longitudinal members 172. The bottom clearance apertures 78 correspond with the plurality of fasteners 194 positioned through a plurality of outer member apertures 196 on the horizontal longitudinal members 172. The passage of the plurality of fasteners 194 through the clearance apertures 78 allows the bottom plate 64 to sit flat against the top surfaces of the horizontal longitudinal members 172.

Alternative housing assemblies incorporating apertures that correspond with the connecting apertures may also be used in conjunction with the base assembly 14. The alternative housing assemblies must also provide clearance for the plurality of fasteners 194 in order for the alternate housing assemblies to sit flush against the horizontal longitudinal members 172.

Figure 33:
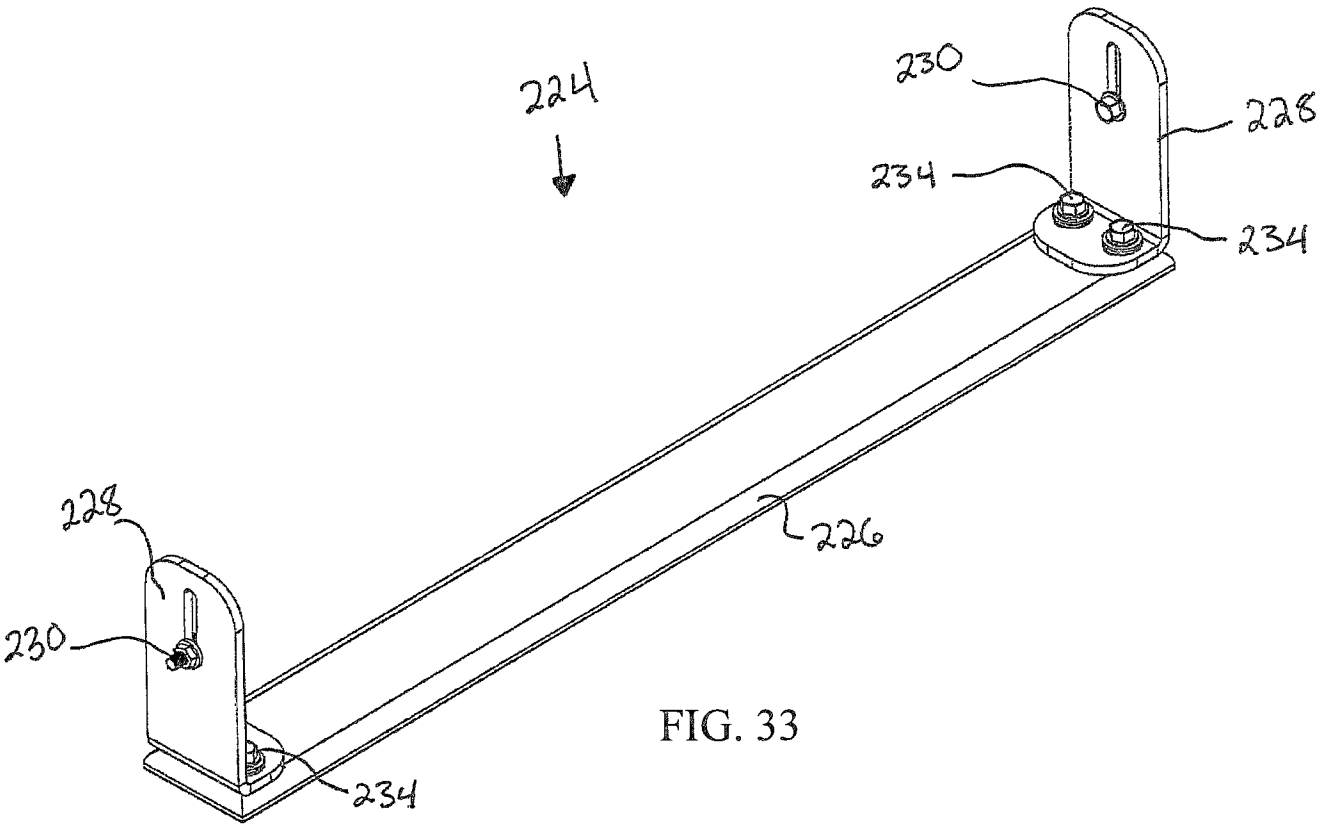
FIG. 33 is a perspective view of a wind mitigation assembly of a storage device.
Figure 35:
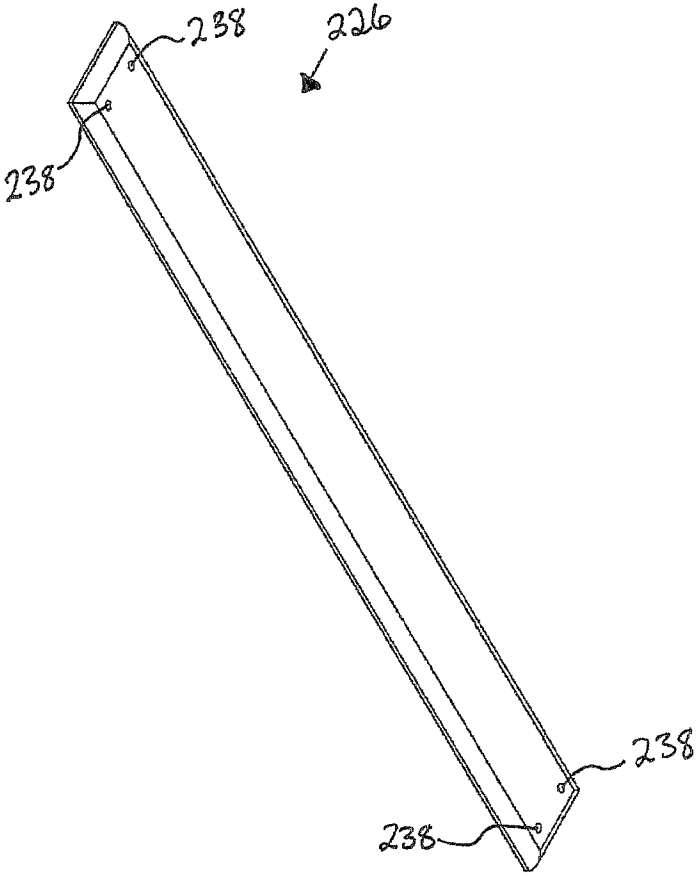
FIG. 35 is a perspective view of a wind mitigation mount of a storage device.
Figure 34:
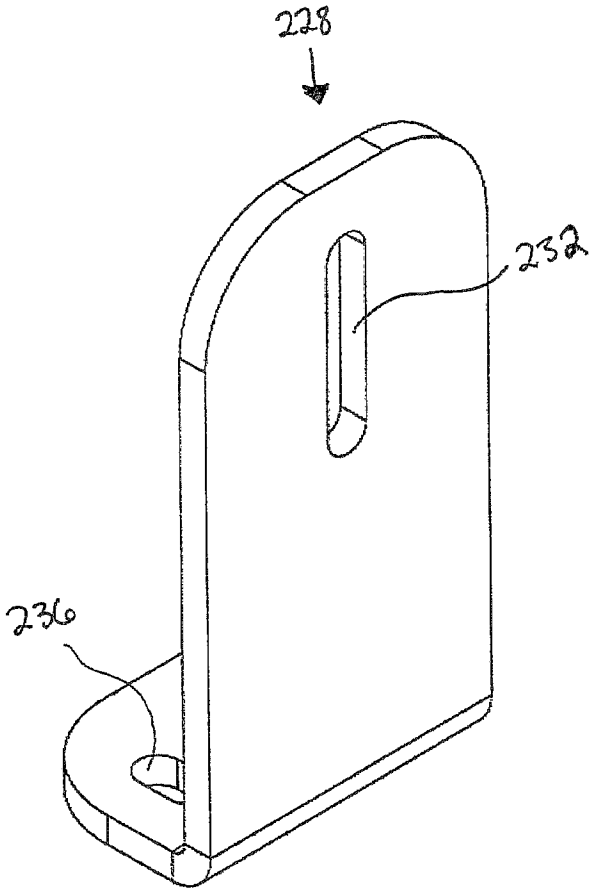
FIG. 34 is a perspective view of a wind mitigation bracket of a storage device.

Now with reference to FIGS. 33 through 35, there is representatively illustrated the wind mitigation assembly 224 in accordance with an embodiment of the invention. The wind mitigation assembly 224 includes a wind mitigation mount 226 and two wind mitigation brackets 228. The wind mitigation mount 226 is adapted to be affixed to the ground. The wind mitigation brackets 228 are adapted to be affixed to the extension apertures 206 by fasteners 230 positioned through the upper mitigation aperture 232 and the extension apertures 206. The wind mitigation brackets 228 are affixed to the wind mitigation mount 226 by fasteners 234 positioned through lower mitigation apertures 236 and mount apertures 238.

A number of embodiments of the present invention have been described. Nevertheless, it will be understood that various modifications may be made without departing from the spirit and scope of the invention. Accordingly, other embodiments are within the scope of the following claims.

What is claimed is:

1. A storage device, comprising:

a housing assembly having a rectangular housing body including a bottom body panel;

a rectangular base assembly comprising:

a leg positioned at each corner of said rectangular base, each leg including a single C-shaped vertical channel;

four supports, one attached to each of said four legs within said single C-shaped vertical channel and extending outwardly therefrom;

a first horizontal member attached at one end to a first support of a first leg and attached at its opposite end to a second of a second leg and longitudinally extending between said first and said second legs along a back side of said rectangular base assembly;

a second horizontal member attached at one end to a third support of a third leg and attached at its opposite end to a fourth support of a fourth leg and longitudinally extending between said third and fourth legs along a front side of said rectangular base assembly;

wherein said housing assembly is disposed on and supported by said rectangular base assembly; and wherein said bottom body panel of said housing body is directly connected to each of said first and second horizontal members by a plurality of bolted connections that are spaced along each of said first and second horizontal members.

2. The storage device of claim 1, wherein each leg includes a leg extension slidingly disposed within said single C-shaped vertical channel.

3. The storage device of claim 1, wherein said first and said second horizontal members include a horizontal channel from through a bottom side thereof; and wherein said first and said second supports are received within the horizontal channel of said first horizontal member, and said third and said fourth supports are received within the horizontal channel of said second horizontal member.

4. The storage device of claim 3, further comprising a plurality of transverse members, each attached at opposite ends to said first and said second horizontal members and extending therebetween at spaced apart locations along said first and said second horizontal members.

5. The storage device of claim 1, wherein a top surface of each of support is substantially flush with a top end of the leg to which the support is connected, and wherein a top surface of each of said first and said horizontal members is substantially flush with the top end of each leg.

6. The storage device of claim 1, wherein said housing body further includes:

a door assembly for providing access to the interior of said housing body, said door assembly including door plate hingedly connected to said housing body, and a door stiffening beam attached to an interior surface of said door plate and extending horizontally on the interior surface.

7. The storage device of claim 6, further comprising:

a door seal, said door seal disposed within a recess of said housing body.

8. The storage device of claim 1, wherein said body housing includes:

a top body panel having a top plate, a back plate connected to said top plate, and a top body channel extending along an edge of said top plate;

a bottom body panel having a bottom body panel channel extend along an edge thereof;

a right body panel having a right body panel channel extending along an edge thereof; and a left body panel having a left body panel channel extending along an edge thereof.

9. A storage device, comprising:

a housing assembly having a rectangular housing body, said housing body comprising a top body panel having a top plate, a back plate connected to said top plate, and a top body channel extending along an edge of said top plate; a bottom body panel having a bottom body panel channel extend along an edge thereof; a right body panel having a right body panel channel extending along an edge thereof; a left body panel having a left body panel channel extending along an edge thereof, said top body panel, said bottom body panel, said right body panel, and said left body panel being connected together forming said housing body;

a rectangular base assembly comprising a leg positioned at each corner of said rectangular base, each leg including a single C-shaped vertical channel; four supports, one attached to each of said four legs within said single C-shaped vertical channel and extending outwardly therefrom; a first horizontal member attached at one end to a first support of a first leg and attached at its opposite end to a second support of a second leg and longitudinally extending between said first and said second legs along a back side of said rectangular base assembly; a second horizontal member attached at one end to a third support of a third leg and attached at its opposite end to a fourth support of a fourth leg and longitudinally extending between said third and fourth legs along a front side of said rectangular base assembly;

wherein said housing assembly is disposed on and supported by said rectangular base assembly; and wherein said bottom body panel of said housing body is directly connected to each of said first and second horizontal members by a plurality of bolted connections that are spaced along each of said first and second horizontal members.

10. The storage device of claim 9, wherein each leg includes a leg extension slidingly disposed within said vertical channel.

11. The storage device of claim 9, wherein said first and said second horizontal members include a horizontal channel from through a bottom side thereof; and wherein said first and said second supports are received within the horizontal channel of said first horizontal member, and said third and said fourth supports are received within the horizontal channel of said second horizontal member.

12. The storage device of claim 11, further comprising a plurality of transverse members, each attached at opposite ends to said first and said second horizontal members and extending therebetween at spaced apart locations along said first and said second horizontal members.

13. The storage device of claim 9, wherein a top surface of each of support is substantially flush with a top end of the leg to which the support is connected, and wherein a top surface of each of said first and said horizontal members is substantially flush with the top end of each leg.

14. The storage device of claim 9, wherein said housing body further includes:

a door assembly for providing access to the interior of said housing body, said door assembly including door plate hingedly connected to said housing body, and a door stiffening beam attached to an interior surface of said door plate and extending horizontally on the interior surface.

15. The storage device of claim 14, further comprising:

a door seal, said door seal disposed within a recess of said housing body.

* * * * *